US010677527B2

(12) United States Patent
Kim et al.

(10) Patent No.: US 10,677,527 B2
(45) **Date of Patent: *Jun. 9, 2020**

(54) WASHSTAND FURNITURE

(71) Applicant: LG ELECTRONICS INC., Seoul (KR)

(72) Inventors: Jongseok Kim, Seoul (KR); Daeyun Park, Seoul (KR); Inhyung Yang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 72 days.

This patent is subject to a terminal disclaimer.

(21) Appl. No.: 15/915,364

(22) Filed: Mar. 8, 2018

(65) Prior Publication Data

US 2018/0259258 A1 Sep. 13, 2018

(30) Foreign Application Priority Data

Mar. 8, 2017 (KR) ..... 10-2017-0029729

(51) Int. Cl.
*F26B 9/06* (2006.01)
*E03C 1/14* (2006.01)
(Continued)

(52) U.S. Cl.
CPC ..... *F26B 9/066* (2013.01); *E03C 1/04* (2013.01); *E03C 1/14* (2013.01); *E03C 1/32* (2013.01); *F26B 3/04* (2013.01); *F26B 21/003* (2013.01); *F26B 21/02* (2013.01); *E03C 2201/40* (2013.01); *E03C 2201/90* (2013.01)

(58) Field of Classification Search
CPC .... F26B 9/00; F26B 9/06; F26B 9/066; A47B 81/02; A47B 81/00; A47B 88/00; A47B 88/403; A47B 88/919; A47B 88/969; A47B 88/988; A47B 88/994; E03C 1/04; E03C 1/00
See application file for complete search history.

(56) References Cited

U.S. PATENT DOCUMENTS 2,175,329 A 10/1939 Watt
2,287,657 A 6/1942 Wisckol
(Continued)

FOREIGN PATENT DOCUMENTS

CN 1718144 1/2006

OTHER PUBLICATIONS

U.S. Office Action dated Sep. 13, 2019 issued in co-pending U.S. Appl. No. 15/915,332.
(Continued)

*Primary Examiner* — Janie M Loeppke
(74) *Attorney, Agent, or Firm* — KED & Associates, LLP

(57) ABSTRACT

A washstand may include a washing device, a cabinet and a dryer. The washing device may include a sink, a water-supply assembly that supplies water to the sink, and a water-discharge assembly that drains water from the sink. The cabinet may be provided below the sink and having an inner space. The dryer may be provided in the cabinet and may include a first outlet in communication with the inner space of the cabinet and a second outlet under the cabinet in communication with an outside of the cabinet. The dryer may be configured to selectively generate airflow through the first outlet to the inner space or through the second outlet to the outside of the cabinet.

20 Claims, 7 Drawing Sheets

(51) Int. Cl.

| | |
|---|---|
| ***E03C 1/04*** | (2006.01) |
| ***F26B 21/00*** | (2006.01) |
| ***E03C 1/32*** | (2006.01) |
| ***F26B 3/04*** | (2006.01) |
| ***F26B 21/02*** | (2006.01) |

(56) References Cited

U.S. PATENT DOCUMENTS

| | | | |
|---|---|---|---|
| 4,146,405 | A | 3/1979 | Timmer |
| 5,522,411 | A | 6/1996 | Johnson |
| 5,702,115 | A | 12/1997 | Pool |
| 5,727,579 | A | 3/1998 | Chardack |
| 5,915,851 | A | 6/1999 | Wattrick et al. |
| 5,934,298 | A | 8/1999 | Singh |
| 6,802,578 | B1 | 10/2004 | Lang |
| 8,245,414 | B2 | 8/2012 | Watson |
| 8,283,812 | B2 | 10/2012 | Azancot |
| 8,991,067 | B2 | 3/2015 | Zielinski |
| 9,255,733 | B2 | 2/2016 | Bagwell |
| 9,887,562 | B2 | 2/2018 | Racenet |
| 10,317,137 | B2 | 6/2019 | Kim |
| 2007/0151302 | A1 | 7/2007 | Kendall |
| 2007/0157378 | A1 | 7/2007 | Kendall et al. |
| 2008/0256826 | A1 | 10/2008 | Zarembinski |
| 2014/0366262 | A1 | 12/2014 | Flynn |
| 2015/0252515 | A1 | 9/2015 | Henry et al. |
| 2016/0128528 | A1 | 5/2016 | Stewen et al. |

OTHER PUBLICATIONS

U.S. Office Action dated Oct. 5, 2018 issued in co-pending U.S. Appl. No. 15/915,216.
U.S. Appl. No. 15/915,193, filed Mar. 8, 2018.
U.S. Appl. No. 15/915,267, filed Mar. 8, 2018.
U.S. Appl. No. 15/915,332, filed Mar. 8, 2018.
U.S. Appl. No. 15/915,401, filed Mar. 8, 2018.
U.S. Appl. No. 15/915,480, filed Mar. 8, 2018.
U.S. Appl. No. 15/915,421, filed Mar. 8, 2018.
U.S. Appl. No. 15/915,216, filed Mar. 8, 2018.
U.S. Appl. No. 15/915,236, filed Mar. 8, 2018.
U.S. Office Action dated May 31, 2019 issued in related U.S. Appl. No. 15/915,193.
U.S. Office Action dated Aug. 30, 2019 issued in co-pending U.S. Appl. No. 15/915,480.
U.S. Office Action dated Oct. 2, 2019 issued in related U.S. Appl. No. 15/915,401.
U.S. Notice of Allowance dated Oct. 19, 2018 issued in co-pending U.S. Appl. No. 15/915,236.
Chinese Office Action (with English translation) dated Mar. 27, 2020 issued in CN Application No. 201810191193.1.
Chinese Office Action (with English translation) dated Mar. 27, 2020 issued in CN Application No. 201810191389.0.

WASHSTAND FURNITURE

CROSS-REFERENCE TO RELATED APPLICATION(S)

This application claims the benefit of Korean patent application No. 10-2017-0029729, filed in Korea on Mar. 8, 2017, the entire content of which is incorporated herein by reference for all purposes as if fully set forth herein.

U.S. application Ser. Nos. 15/915,193; 15/915,364; 15/915,267; 15/915,332; 15/915,401; 15/915,480; 15/915,421; 15/915,216; 15/915,236, all filed on Mar. 8, 2018, are related and are hereby incorporated by reference in their entirety. Further, one of ordinary skill in the art will recognize that features disclosed in these above-noted applications may be combined in any combination with features disclosed herein.

BACKGROUND

1. Field

The present disclosure relate to a washstand that utilizes space under a sink, and more particularly to a washstand that includes a dryer below the washstand.

2. Background

Washstands are known. However, they suffer from various disadvantages.

BRIEF DESCRIPTION OF THE DRAWINGS

Embodiments will be described in detail with reference to the following drawings in which like reference numerals refer to like elements, and wherein.

DETAILED DESCRIPTION

Figure 1:
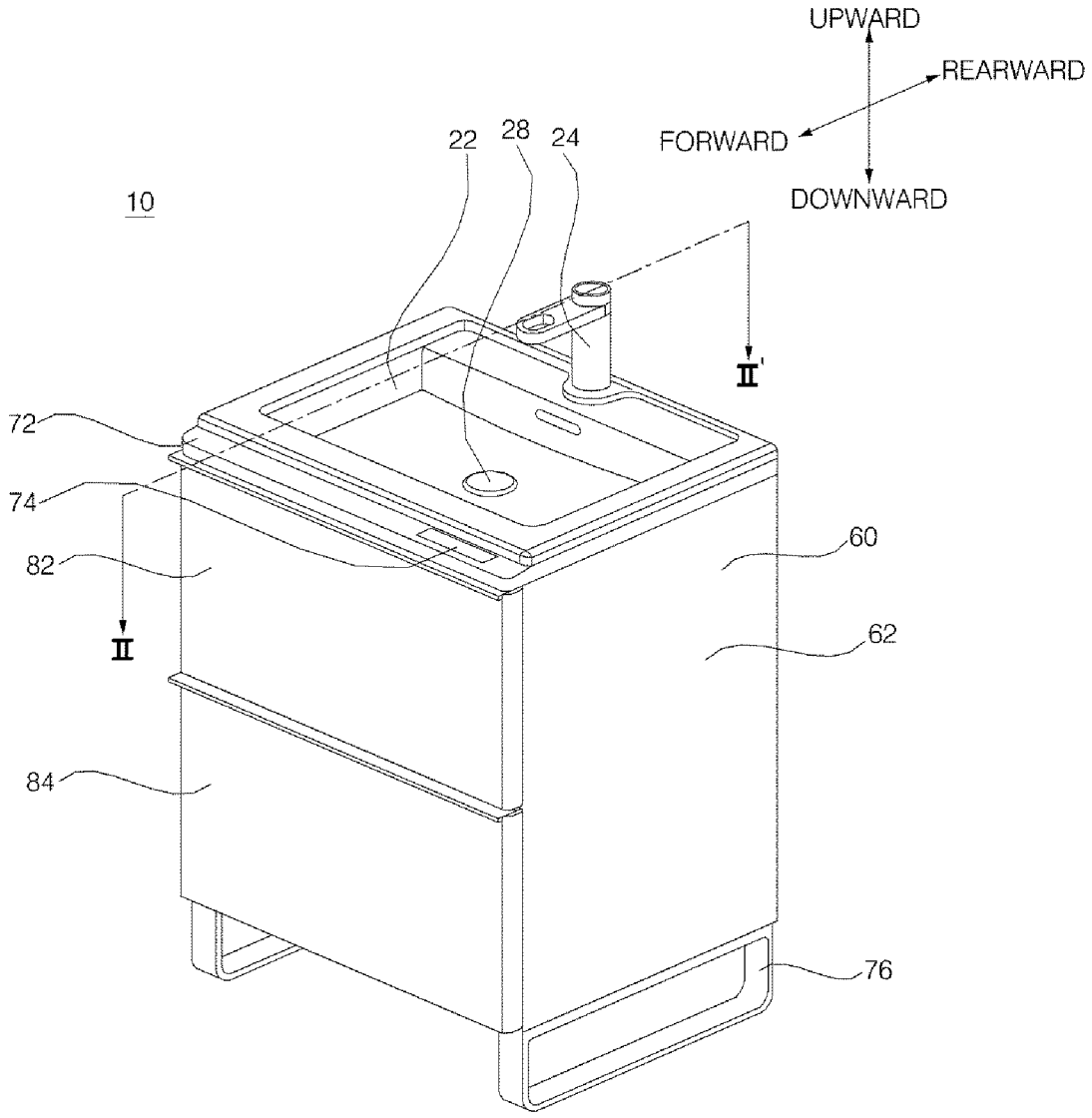
FIG. 1 is a perspective view of washstand furniture according to one embodiment of the present disclosure.

For simplicity and clarity of illustration, elements in the figures are not necessarily drawn to scale. The same reference numbers in different figures denote the same or similar elements, and as such perform similar functionality. Also, descriptions and details of well-known steps and elements are omitted for simplicity of the description. Furthermore, in the following detailed description of the present disclosure, numerous specific details are set forth in order to provide a thorough understanding of the present disclosure. However, it will be understood that the present disclosure may be practiced without these specific details. In other instances, well-known methods, procedures, components, and circuits have not been described in detail so as not to unnecessarily obscure aspects of the present disclosure.

Examples of various embodiments are illustrated and described further below. It will be understood that the description herein is not intended to limit the claims to the specific embodiments described. On the contrary, it is intended to cover alternatives, modifications, and equivalents as may be included within the spirit and scope of the present disclosure as defined by the appended claims.

It will be understood that, although the terms "first", "second", "third", and so on may be used herein to describe various elements, components, regions, layers or regions, these elements, components, regions, layers or regions should not be limited by these terms. These terms are used to distinguish one element, component, region, layer or region from another element, component, region, layer or region. Thus, a first element, component, region, layer or region described below could be termed a second element, component, region, layer or region, without departing from the spirit and scope of the present disclosure.

It will be understood that when an element or layer is referred to as being "connected to", or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

Spatially relative terms, such as "beneath," "below," "lower," "under," "above," "upper," and the like, may be used herein for ease of explanation to describe one element or feature's relationship to another element s or feature s as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented for example, rotated 90 degrees or at other orientations, and the spatially relative descriptors used herein should be interpreted accordingly.

The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "includes", "including", "includes", and "including" when used in this specification, specify the presence of the stated features, integers, operations, elements, or components, but do not preclude the presence or addition of one or more other features, integers, operations, elements, components, or portions thereof. As used herein, the term "and/or" includes any and all combinations of one or more of the associated listed items. Expression such as "at least one of" when preceding a list of elements may modify the entire list of elements and may not modify the individual elements of the list.

Unless otherwise defined, all terms including technical and scientific terms used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

In the following description, numerous specific details are set forth in order to provide a thorough understanding of the present disclosure. The present disclosure may be practiced without some or all of these specific details. In other instances, well-known process structures or processes have not been described in detail in order not to unnecessarily obscure the present disclosure.

Bathrooms are mostly humid spaces. Thus, there are problems in controlling fungus or bacteria in various areas of the bathroom. First, water and moisture may find its way inside walls, on the floor, and between tiles, and contribute to fungus or bacteria in these places. This may especially be the case for lower surfaces.

Second, mold and bacteria may occur due to the high humidity environment of the bathroom, especially in spaces for storing articles used in the bathroom. Bathrooms have a relatively small amount of storage space. Therefore, washstand furniture (or washstand, vanity) may be installed for additional the storage space, by utilizing spaces above or below the washstand. In an inner space of such a washstand, the high humidity environment may cause fungi and bacteria.

In particular, areas of the washstand located below the sink contains therein water supply and drainage systems. Therefore, the storage space thereof may be narrowed. Further, water and moisture may easily flow into the inner space of the washstand from the sink above there. As a result, objects placed in the internal space of the furniture may be contaminated with fungi and bacteria as reproduced therein. Finally, various bathroom utensils or toiletries, including towels or shower means used in the bathroom, are frequently wet and are more susceptible to being infected with molds. The washstand of the present disclosure addresses these disadvantages and problems.

Figure 2:
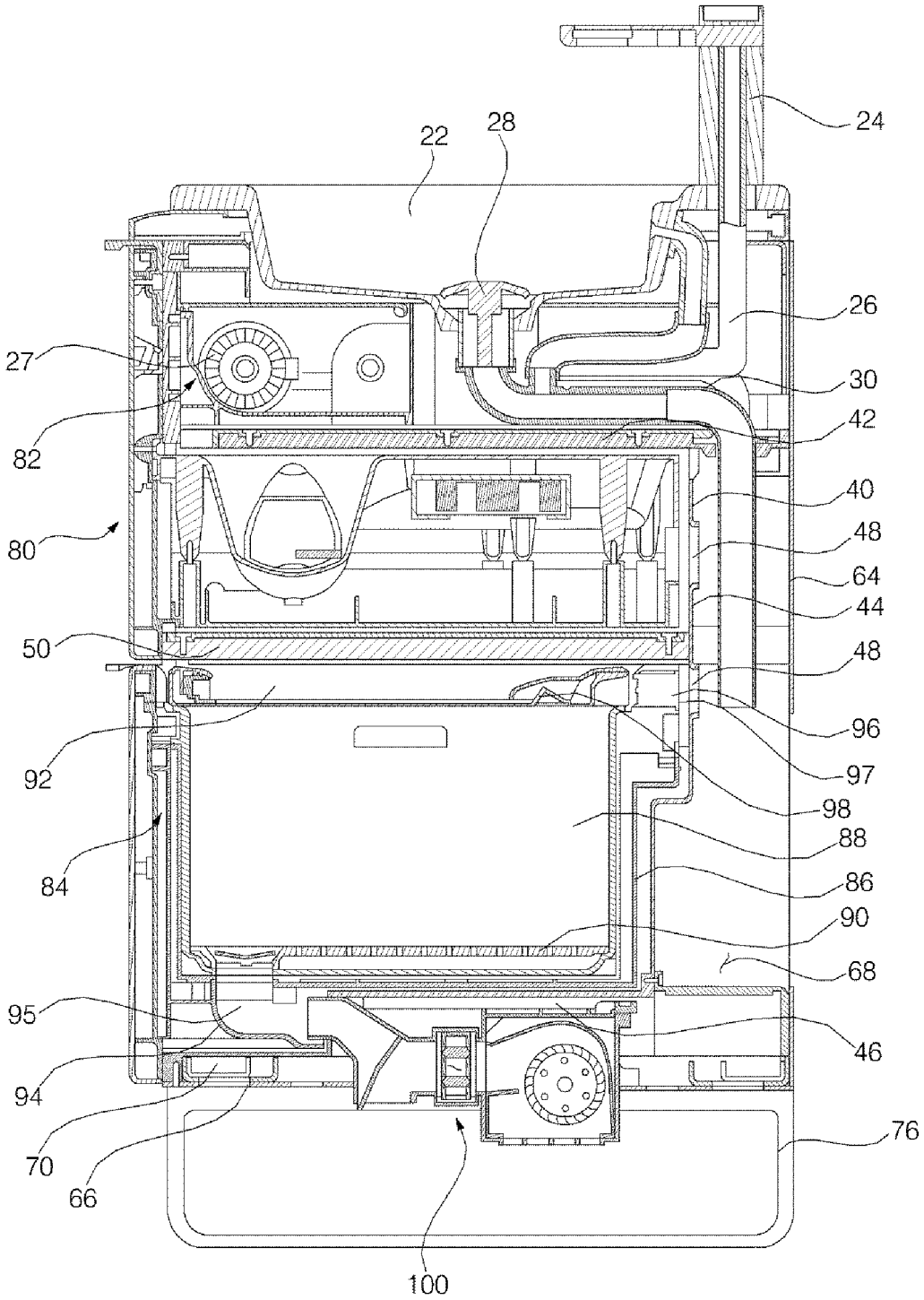
FIG. 2 is a cross-sectional view taken in line II-II' in FIG. 1.

FIG. 1 is a perspective view of washstand furniture according to one embodiment of the present disclosure. FIG. 2 is a cross-sectional view taken in line II-II' in FIG. 1. The washstand furniture 10 (or washstand, vanity) may include a washing device, a cabinet, and an air-conditioning device 100 (or dryer), wherein the washing device includes a bowl portion 22 (or sink, basin, bowl); a water-supply assembly for supplying water to the bowl portion 22; and a water-discharge assembly for discharging water from the bowl portion 22. The cabinet may be disposed below the bowl portion 22 and may have an inner space defined therein for receiving a functional-module therein (such as a heated drawer). An air-conditioning device 100 may be configured to selectively inject air into a first outlet 104 opened toward a bottom of a bathroom or into a second outlet 106 air-communicating with the functional-module disposed in the cabinet.

With reference to FIG. 1, for describing the washstand furniture according to the present embodiment, a direction in which the functional-module is drawn out to the outside of the cabinet is defined as forward (F), the reverse direction (R) is defined as opposite to the forward direction, and a portion in which the bowl portion is disposed is defined as an upper portion (U), and a portion in which a furniture legs are disposed is defined as a lower portion (L). This is merely for the purpose of facilitating description of various features and does not limit the scope of the present disclosure.

A washing device may be a device that is installed on the wall of a bathroom or washroom and is designed to allow the user to wash hands or face. The washing device may include the bowl portion 22 (or sink, basin, bowl) for receiving water therein, the water-supply assembly for supplying water to the bowl portion 22, and the water-discharge assembly for draining the water supplied to the bowl portion 22.

The bowl portion 22 may be made of enamel, ceramic, or the like. It may be preferable that the bowl is formed of enamel which allows the bowl portion to be morphologically deformable and easily coupled with the cabinet. The bowl portion 22 may be disposed at the top portion of the washstand 10.

The water-supply assembly includes a water-supply valve 24 (or faucet) that opens or closes to supply water to the bowl portion 22, and a water-supply hose 26 for supplying water to the water-supply valve 24. The water-supply valve 24 may be disposed at one side of the bowl portion 22 to control the supply of water to the bowl portion 22. The water-supply hose 26 may include a hot water-supply hose supplying hot water and a cold water-supply hose supplying cold water.

The water-supply assembly may further comprise a water-purification filter 27 for purifying the water entering the water-supply hose 26. The water-purification filter 27 is configured to purify the water to be supplied to the bowl portion 22 through the water-supply valve 24. The water-discharge assembly includes a water-discharge tube 30 for discharging the water stored in the bowl portion 22 to the outside, and a pop-up valve 28 (or drain plug) for storing water in the bowl portion 22 or for draining the filled water to the water-discharge tube 30.

Below the washing device, a cabinet may be provided that forms the contour and outer shape of the washstand 10. The cabinet maintains the rigidity of the washstand 10 and provides a space for the functional-module therein. The cabinet may be hollow and has an open front. The cabinet may include an inner cabinet 40 for accommodating a functional-module therein, and an outer cabinet 60 disposed outside the inner cabinet 40 to maintain the rigidity of the cabinet. The washstand 10 may include the inner cabinet 40 and the outer cabinet 60. Thus, additional protection may be provided against inflow of water into the functional-module or spaces housed inside the inner cabinet 40.

The inner cabinet 40 may have a box shape in which the inside is hollow and the front is opened. The outer cabinet 60 may be disposed outside the inner cabinet 40. The outer cabinet 60 may include lateral outer cabinets 62 arranged to cover both sides of the inner cabinet 40, a rear outer cabinet 64 disposed to cover a rear face 44 of the inner cabinet 40, and a base outer cabinet 66 disposed to cover a bottom face 46 of the inner cabinet 40.

In the inner side face of the inner cabinet 40, a rail member (or rails) configured for moving or sliding the functional-module inside or outside the inner cabinet 40 may be disposed. The inner cabinet 40 may have an air-communication hole 48 defined in a position corresponding to a position where an air-inlet or outlet of the functional-module is formed. The inner cabinet 40 may have, in the bottom face 46 (or bottom surface) thereof, the air-communication hole 48 communicating with the outlet of the air-conditioning device 100. A portion of a housing 110 defining the outlet of the air-conditioning device 100 passes through the air-communication hole 48 formed in the bottom face 46 of the inner cabinet 40.

An external connection path 68 (or external connection recess/channel) may be formed between the rear face 44 of the inner cabinet 40 and the rear outer cabinet 64 to allow air to flow inside the functional-module and outside the washstand 10. The external connection path 68 may be open at the bottom, and thus, air-communicated to the outside of washstand 10.

Between the bottom face 46 of the inner cabinet 40 and the base outer cabinet 66, the air-conditioning device 100 may be disposed. The washstand 10 may further include a frame 70 forming a skeleton between the inner cabinet 40 and the outer cabinet 60. The frame 70 serves to minimize the transfer of the load of the washing device to the cabinet. The inner cabinet 40 may accommodate the functional-modules therein. The functional-module may be a device that is housed in the cabinet and operates electrically. The cabinet may house multiple functional-modules therein. The functional-module may be a heated drawer assembly, or the like, examples of which are discussed below.

The washstand 10 may include a first functional-module 84 and a second functional-module 80, both being disposed within the inner cabinet 40. The first functional-module 84 may be disposed at a lower region of the inner cabinet 40 and the second functional-module 80 may be disposed at an upper region of the inner cabinet 40.

The washstand 10 may further include a third functional-module 82 disposed between the inner cabinet 40 and the bowl portion 22. The third functional-module 82 may include a water-purification filter 27 for purifying the water supplied to the water-supply assembly and/or a printed circuit board for controlling power supplied to and/or operations of the air-conditioning device 100 or a plurality of functional-modules.

The washstand 10 may include a partition block 50 that divides spaces that accommodate a plurality of functional-modules of the inner cabinet 40 from one another. The partition block 50 may separate the spaces that accommodate the plurality of functional-modules within the inner cabinet 40 from each other. Further, in the partition block 50, electrical wiring for supplying power to a functional-module and configured to accommodate the functional-module that is configured to move forward within the cabinet may be disposed.

The washstand 10 may include an upper cover 72 disposed between the sink 22 of the washstand and the cabinet for primarily receiving water falling from the sink 22. The washstand 10 may include an input unit 74 for inputting user commands for operating a plurality of functional-modules and/or the air-conditioning device 100. The input unit 74 may be disposed on one side of the upper cover 72. The washstand 10 may further include washstand legs 76 (or stand, support) that space the cabinet from the floor of the bathroom by a predetermined distance.

Hereinafter, with reference to FIG. 2, the first functional-module 84 configured for use with the air-conditioning device 100 is described in further detail. The first functional-module 84 or 'utensil drying functional-module' may dry bathroom utensils or other objects that are available in the bathroom. The first functional-module 84 use hot air blown from the air-conditioning device 100, described below, to dry the objects. The first functional-module 84 may configured as a drawer unit, and hence, may also be referred to herein as a heated drawer assembly.

The first functional-module or heated drawer assembly 84 may include a drawer 86 movably disposed in the cabinet and having an internal space defined therein, a basket 88 detachably disposed inside the drawer 86, and a rack 90 disposed within the basket 88 for holding the utensils. The drawer 86 may be formed so that its interior is hollow and its top is open. The basket 88 may be detachable through the opened top of the drawer 86.

The drawer 86 may have a box shape in which the inside is hollow and the top is opened. At the opened top of the drawer 86, a door 92 for opening and closing the top of the drawer 86 may be disposed. The door 92 may be hinge-coupled to the top of the drawer 86. The door 92 may open and close the open top portion of the drawer 86. When the top of the drawer 86 is opened, the user may take the basket 88 out of the drawer 86 or insert the basket 88 into the drawer 86.

The first functional-module 84 may further include an air-inlet member 94 (or air inlet, connection duct) having therein an inlet passage 95 therein in communication with the air-conditioning device 100, and an air-outlet member 96 (or air outlet) having an outlet 97 (or opening) defined therein to allow air inside the first functional-module 84 to be discharged outside the first functional-module 84.

The drawer 86 may receive the air-inlet member 94 connected to the air-conditioning device 100. The air-inlet member 94 may be disposed in the lower portion of the drawer 86. The air-inlet member 94 may be formed by a bottom surface of the first functional-module 84. The warm air discharged from the air-conditioning device 100 may flow into the first functional-module 84. One end of the air-inlet member 94 may be provided to air-communicate with the second outlet 106 of the air-conditioning device 100. The air-inlet member 94 may have a prescribed shape that extends down from a bottom of the first functional-module 84 and toward the rear to be coupled to the air conditioning device 100.

Figure 5:
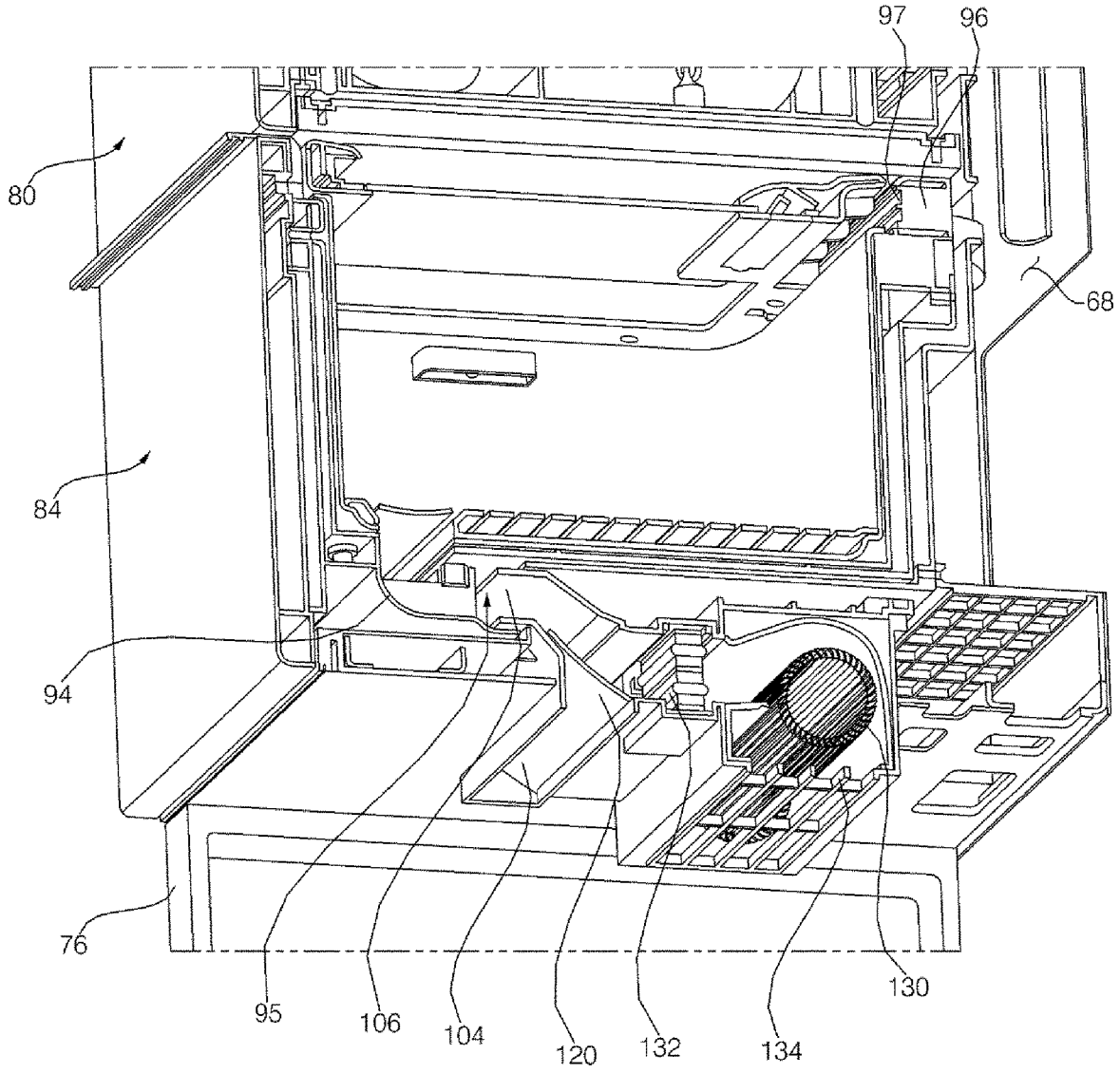
FIG. 5 is a bottom perspective view of the air-conditioning device of the washstand furniture and a portion of the first functional-module as shown in FIG. 2.

With the drawer 86 being inserted into the cabinet, the air-inlet member 94 air-communicates with the second outlet 106 of the air-conditioning device 100. Specifically, as shown in FIG. 5, a portion of the housing 110 defining the second outlet 106 is inserted into the inlet passage 95 of the air-inlet member 94. When the drawer 86 is pulled out, the air-inlet member 94 may be disconnected form the second outlet 106.

The drawer 86 may include an air-outlet member 96 having an outlet 97 therein to allow the air inside the functional-module to be discharged outside the functional-module. The air-outlet member 96 may be disposed in the upper portion of the drawer 86. The air-outlet member 96 allows air-communication between the interior of the first functional-module 84 and the external connection path 68 via the outlet 97.

The air-outlet member 96 is shown as being separate from the drawer 86, but the present disclosure is not limited thereto. For example, the air-outlet member 96 may be formed integrally with the drawer 86. The first functional-module 84 may use the air-outlet member 96 to allow the air inside the functional-module to be discharged to the external connection path 68.

The first functional-module 84 may further include an ultraviolet lamp 98 that sterilizes the utensil disposed within the drawer 86. The ultraviolet lamp 98 may be disposed inside the door 92.

Figure 3:
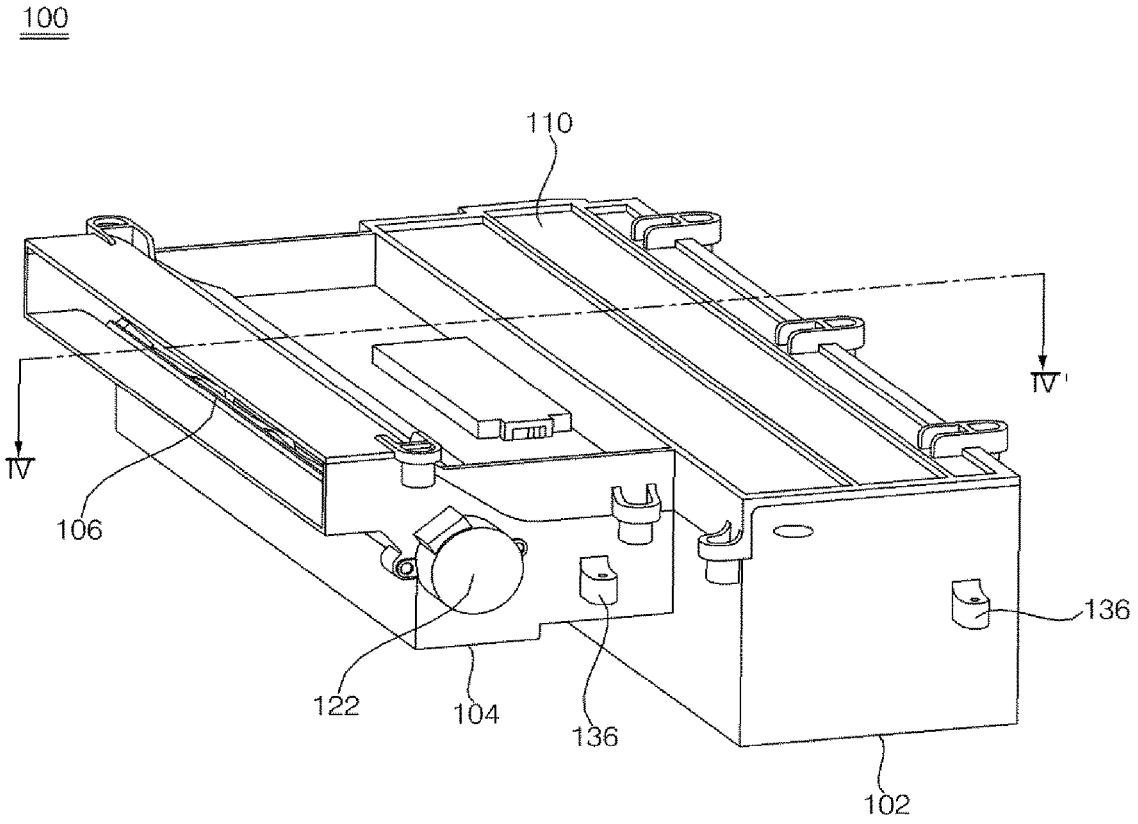
FIG. 3 is a perspective view of the air-conditioning device used in a washstand furniture according to an embodiment of the present disclosure.
Figure 4:
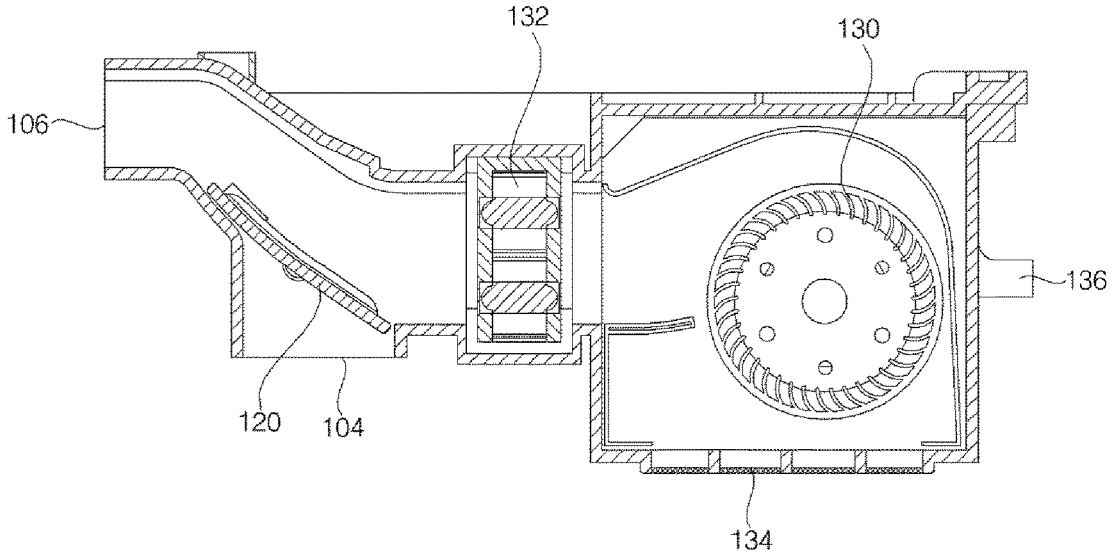
FIG. 4 is a sectional view taken along the line IV-IV'.
Figure 6A:
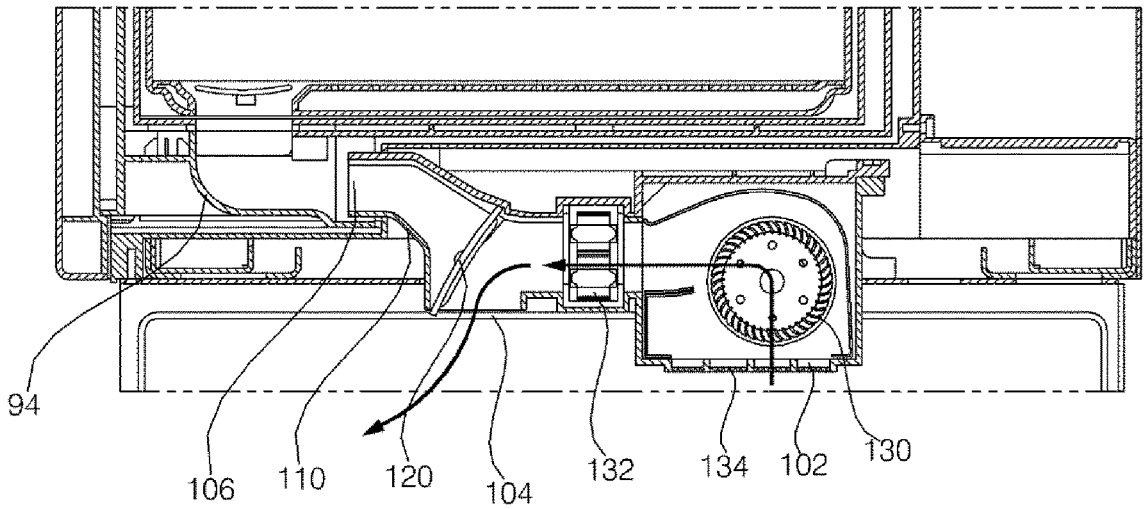
FIG. 6A is a diagram illustrating air-flow when the air-conditioning device according to an embodiment of the present disclosure is in a bottom dehumidifying mode.
Figure 6B:
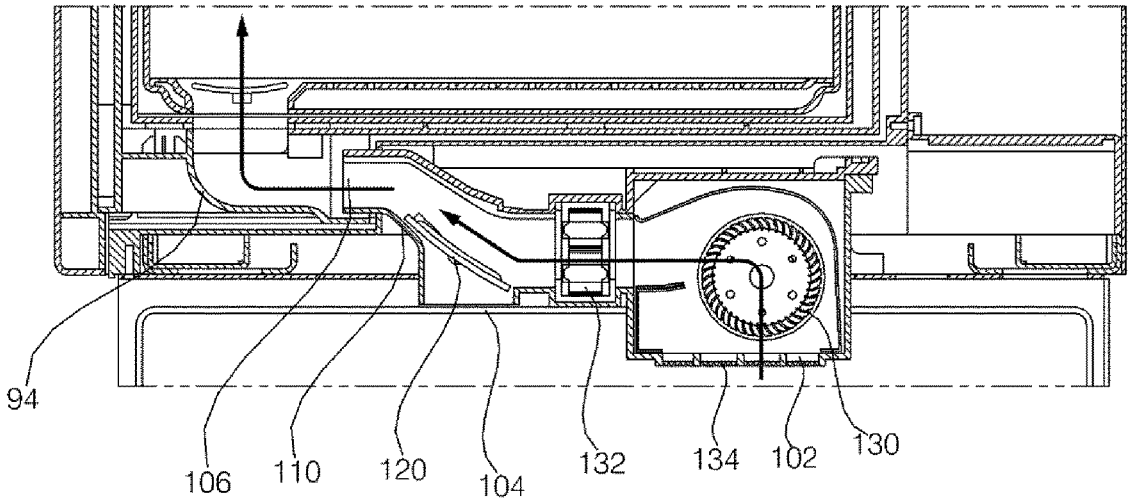
FIG. 6B is an air-flow diagram when the air-conditioning device according to an embodiment of the present disclosure is in a functional-module drying mode.
Figure 7:
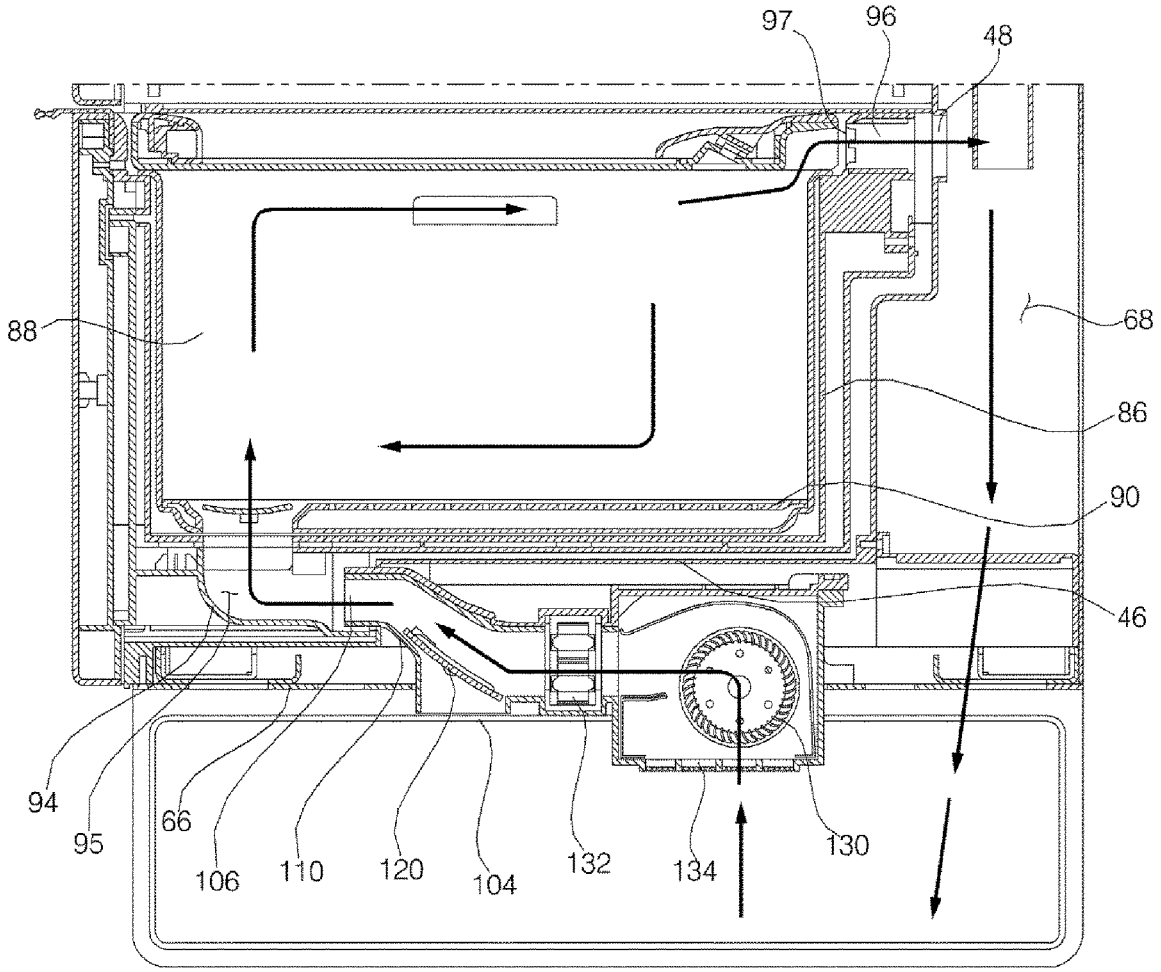
FIG. 7 shows air-flow in the first functional-module according to the operation of the air-conditioning device in FIG. 6.

FIG. 3 is a perspective view of the air-conditioning device used in a washstand according to an embodiment of the present disclosure. FIG. 4 is a sectional view taken along the line IV-IV'. FIG. 5 is a bottom perspective view of the air-conditioning device of the washstand and a portion of the first functional-module as shown in FIG. 2. FIG. 6A is a diagram illustrating air-flow when the air-conditioning device is in a bottom dehumidifying mode. FIG. 6B is an air-flow diagram when the air-conditioning device is in a functional-module drying mode. FIG. 7 shows air-flow in the first functional-module according to the operation of the air-conditioning device in FIG. 6.

The air-conditioning device 100 may discharge air to dehumidify the bottom of the bathroom or to dry the inside of the functional-module disposed inside the cabinet. The air-conditioning device 100 uses a fan 130 to discharge air to the first outlet 104, which faces the floor of the bathroom, or to the second outlet 106, which leads into the cabinet.

The air-conditioning device 100 may be disposed in the lower portion of the inner cabinet. The air-conditioning device 100 may discharge air into the cabinet. The air-conditioning device 100 may discharge air to the first functional-module 84 disposed within the cabinet in the lower portion thereof. The air-conditioning device 100 may be disposed below the bottom face 46 of the inner cabinet 40.

The air-conditioning device 100 may be spaced apart from the bottom surface or floor of the bathroom by a predetermined distance. The air-conditioning device 100 may be spaced at a certain distance from the bottom surface of the bathroom and discharges air toward the bottom surface of the bathroom. The air-conditioning device 100 may be disposed between the bottom face 46 of the inner cabinet 40 and the base outer cabinet 66. A portion of the housing 110 of the air-conditioning device 100 may protrude into a lower portion of the base outer cabinet 66. The air-conditioning device 100 may be mounted to the base outer cabinet 66.

The air-conditioning device 100 may include the housing 110 which has an inlet 102 defined therein, a first outlet 104 used to dry the floor, and a second outlet 106 used to dry the interior of the functional-module disposed within the cabinet. The air-conditioning device 100 may include a fan 130 disposed inside the housing 110 to generate airflow from the inlet 102 to the first outlet 104 or the second outlet 106; and an vane 120 for discharging air flowing inside the housing 110 to the first air outlet 104 or the second air outlet 106. The air-conditioning device 100 further includes a filter 134 for filtering air sucked into the inlet 102 of the housing 110.

The air-conditioning device 100 may further include a heater 132 for heating the air flowing inside the air-conditioning device 100. The air-conditioning device 100 may have various functions that condition the air such as heating, cooling, filtering, dehumidifying, or the like. Merely for ease of description, the air-conditioning device 100 of the present disclosure is also referred to herein as a dryer.

The housing 110 may define the contour of the air-conditioning device 100. The housing 110 is fastened to the cabinet. The housing 110 includes a plurality of fasteners 136 for fastening the housing to a bottom face of the inner cabinet 40 or the base outer cabinet 66.

The housing 110 of the air-conditioning device 100 may have one inlet 102 and two outlets. In the housing 110, the inlet 102 for sucking outside air, the first outlet 104 opened downward, and the second outlet 106 opened toward the functional-module may be disposed inside the cabinet.

The inlet 102 may be defined in one side of the housing 110. The inlet 102 may be defined in the rear side of the lower portion of the housing 110. One of the two outlets may be open towards the bottom of the bathroom, and the other may be open toward the air-inlet member 94 of the first functional-module 84. The first outlet 104 may be defined in the front side of the lower portion of the housing 110. The first outlet 104 may open toward the bottom of the bathroom. The second outlet 106 may open to the front of the housing 110. The second outlet 106 may open toward the space formed inside the cabinet. The second outlet 106 may be opened toward the inlet passage 95 inside the air-inlet member 94 of the first functional-module 84.

In the housing 110, a portion of the housing 110 defining the inlet 102 and the first outlet 104 may protrude into a lower portion of the base outer cabinet 66. In the housing 110, a portion of the housing 110 defining the second outlet 106 may pass through the air-flow hole of the inner cabinet 40. A portion of the housing 110 defining the second outlet 106 may be inserted into an inlet passage 95 formed within the air-inlet member 94 of the first functional-module 84.

Inside the housing 110, the fan 130 may be disposed to generate airflow from the inlet 102 to the first outlet 104 or the second outlet 106. Inside the housing 110, the heater 132 for heating the flowing air may be disposed. Inside the housing 110, a vane 120 may be disposed to selectively guide the flowing air to the first air outlet 104 or the second air outlet 106.

The vane 120 may open and close the first outlet 104 or the second outlet 106. The vane 120 may be operated by a vane drive motor 122. By the operation of the vane drive motor 122, the first outlet 104 or the second outlet 106 may be opened and closed. Via the operation of the vane 120, the first outlet 104 and the second outlet 106 may be selectively opened and closed. When the first outlet 104 is opened, the second outlet 106 may be closed, while when the first outlet 104 is closed, the second outlet 106 may be opened.

When the vane 120 is arranged as shown in FIG. 6*a*, air is discharged to the first outlet 104. The first outlet 104 opens to the bottom of the bathroom and is used to dry the floor of the bathroom. When the vane 120 is arranged as shown in FIG. 6*b*, air is injected to the second outlet 106. The second outlet 106 discharges air to the functional-module housed inside the cabinet to dry the inside of the functional-module.

The vane drive motor 122 may be disposed outside the housing 110. The vane drive motor 122 may rotate the vane 120 within a certain rotation range.

The fan 130 causes external air to be sucked into the inlet 102 and the air may be discharged to the first outlet 104 or the second outlet 106. The fan 130 may be a cross-flow fan, or another appropriate type of fan, capable of sucking air from the inlet 102 defined in the rear side of the lower portion of the housing 110 and discharging air toward the outlet formed in the front of the housing.

Hereinafter, with reference to FIG. 6 to FIG. 7, the operation mode of the air-conditioning device 100 according to one embodiment will be described. The air-conditioning device 100 may operate in a bottom dehumidifying mode for dehumidifying the bottom or floor of the bathroom, or a functional-module drying mode for drying the interior of a functional-module disposed in the cabinet. The air-conditioning device 100 may selectively open the first outlet 104 or the second outlet 106 via the operation of the vane 120. The air-conditioning device 100 may selectively open and close the first outlet 104 and the second outlet 106 according to the selected operation mode.

The air-conditioning device 100, in the bottom dehumidifying mode, opens the first outlet 104 and closes the second outlet 106. The air-conditioning device 100, in the bottom dehumidifying mode, may allow the vane 120 to be oriented as shown in FIG. 6A.

In the bottom dehumidifying mode, the air-conditioning device 100 may discharge air to the first outlet 104. In the bottom dehumidifying mode, via the operation of the heater 132 and the fan 130, warm air flows in a forcedly-convection manner to the floor of the bathroom, thereby drying the floor as well as regions under the washstand. The air-conditioning device 100, in the functional-module drying mode, may open the second outlet 106 and close the first outlet 104. In the functional-module drying mode, the air-conditioning device 100 may allow the vane 120 to be oriented as shown in FIG. 6B.

In functional-module drying mode, the air-conditioning device 100 may discharge air to the second outlet 106. The air-conditioning device 100 may operate the heater 132 and the fan 130 to dry the interior of the functional-module by discharging warm air into the functional-module.

More specifically, with reference to FIG. 7, in the functional-module drying mode, the air-conditioning device 100 may direct the vane 120 to open the second outlet 106. The air-conditioning device 100 may operate the heater 132 and the fan 130 to discharge the heated air into the first functional-module 84. The heated air enters the first functional-module 84 through the air-inlet member 94 in communication with the second outlet 106. In the first functional-module 84, the warm air dries the utensils held inside the functional-module. Air flowing inside the first functional-module 84 flows through the outlet 97 to the external connection path 68 and then flows downwardly through the external connection path 68.

Embodiments of the present disclosure are to provide a washstand that may dry the floor of the bathroom and the interior of the washstand. Embodiments of the present disclosure are to provide a washstand having a space used for drying utensils used in a bathroom. The purposes of the present disclosure are not limited to the above-mentioned purposes. Other purposes and aspects not mentioned herein may be clearly understood by those skilled in the art from the description.

In a first aspect of the present disclosure, there is provided a washstand which may comprise: a washing device including: a bowl portion; a water-supply assembly for supplying water to the bowl portion; and a water-discharge assembly for discharging water from the bowl portion; a cabinet disposed below the bowl portion and having an inner space defined therein; and an air-conditioning device configured to selectively inject air into a first outlet opened toward a bottom of a bathroom or into a second outlet air-communicating with the inner space in the cabinet.

In one implementation of the first aspect, the air-conditioning device may include: a vane configured to switch the air discharge into the first outlet or the second outlet; and a vane drive motor for driving the vane.

In one implementation of the first aspect, the air-conditioning device may include: a housing defining an outer shape of the furniture, wherein the housing has an inlet defined therein for sucking air into the housing, and the first outlet and the second outlet defined therein; a fan disposed inside the housing to enable air flow from the inlet to the first outlet or the second outlet; and an vane configured to switch the air discharge into the first outlet or the second outlet.

In one implementation of the first aspect, the inlet and the first outlet are defined in a lower portion of the housing. The air-conditioning device may further include a heater for heating air flowing therein.

In one implementation of the first aspect, the washstand may further include a utensil drying functional-module housed within the cabinet to dry utensils housed therein using air discharged from the air-conditioning device.

In one implementation of the first aspect, the utensil drying functional-module may include an air-inlet member having an inlet passage defined therein, wherein the inlet passage air-communicates with the second outlet of the air-conditioning device; and an air-outlet member having an outlet defined therein, through which air in the functional-module is discharged out of the functional-module.

In one implementation of the first aspect, a portion of the housing defining the second outlet may be inserted into the inlet passage inside the air-inlet member.

In one implementation of the first aspect, the cabinet may include: an inner cabinet having the inner space defined therein; and a base outer cabinet covering a bottom portion of the inner cabinet, wherein the air-conditioning device is disposed between the bottom portion of the inner cabinet and the base outer cabinet, to discharge air into the inner space defined in the inner cabinet.

In one implementation of the first aspect, the air-conditioning device further may include a filter for filtering air entering the inlet.

The advantages of the present disclosure are provided in non-limiting examples as follows. First, the washstand according to the present disclosure may include the air-conditioning device which selectively discharges air into the inner space in the cabinet or the bottom of the bathroom through the selective two outlets. This allows the single air-conditioning device to dry the two regions such as the inner space in the washstand or the bathroom floor.

Second, the washstand according to the present disclosure includes the utensil drying functional-module capable of drying the utensils used in the bathroom, using hot air discharged from the air-conditioning device therein. This allows the user to quickly dry the utensils in the bathrooms and keep the bathroom utensils clean.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present disclosure.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A washstand comprising:

a washing device including;

a sink;

a water-supply assembly that supplies water to the sink; and a water-discharge assembly that drains water from the sink;

a cabinet provided below the sink and having an inner space; and a dryer provided in the cabinet and including a first outlet under the cabinet in communication with an outside of the cabinet and a second outlet in communication with the inner space of the cabinet, the dryer being configured to selectively generate airflow through the first outlet to the outside of the cabinet or through the second outlet to the inner space, wherein the dryer includes:

a housing that defines an outer surface of the dryer, wherein an inlet that allows air to flow into the housing, the first outlet, and the second outlet is provided on the housing, a fan provided inside the housing to generate air flow from the inlet to the first outlet or the second outlet, and a vane configured to switch a path of the airflow to discharge through the first outlet or the second outlet.

2. The washstand of claim 1, wherein the dryer includes a vane drive motor that drives the vane.

3. The washstand of claim 1, wherein the inlet and the first outlet are provided in a lower portion of the housing.

4. The washstand of claim 3, wherein when the vane is in a first position, a first air passage is formed in the housing that extends from the inlet to the first outlet, and when the vane is in a second position, a second air passage is formed in the housing that extends from the inlet to the second outlet.

5. The washstand of claim 4, wherein, in the first position to discharge air out of the cabinet, the vane is positioned such that the first distal end is positioned at an upper surface of the housing and the second distal end is positioned at the bottom surface of the housing.

6. The washstand of claim 5, wherein, in the second position to generate airflow into the inner space, the vane is positioned such that a first distal end is positioned at a bottom surface of the housing at one side of the second outlet and a second distal end is positioned at the bottom surface of the housing at another side of the second outlet.

7. The washstand of claim 1, wherein the dryer includes a filter provided at the inlet at a bottom of the cabinet to filter air entering the inlet.

8. The washstand of claim 1, wherein the dryer includes a heater provided in the housing and configured to dry air flowing through the housing.

9. The washstand of claim 1, further comprising a heated drawer assembly provided in the inner space of the cabinet and configured to dry items using heated air generated by the dryer.

10. The washstand of claim 9, wherein the heated drawer assembly includes an air inlet in communication with the second outlet of the dryer, and an air outlet to discharge air from the heated drawer assembly.

11. The washstand of claim 10, wherein the air inlet includes an air passage that extends at a bottom portion of the heated drawer assembly.

12. The washstand of claim 11, wherein a portion of the housing that defines the second outlet of the dryer is inserted into the air passage of the air inlet.

13. The washstand of claim 11, wherein the air inlet is formed by a bottom surface of the heated drawer assembly, the bottom surface that forms the air inlet being extended from a front side of the heated drawer assembly toward a rear side.

14. The washstand claim 13, wherein the air inlet has a first opening provided at an upper end of the air inlet and a second opening provided at a lower distal end of the air inlet, the air passage extending from the first opening to the second opening.

15. The washstand of claim 14, wherein the second opening has a prescribed shape that accommodates the second outlet of the dryer to be inserted into the second opening.

16. The washstand of claim 15, wherein the heated drawer assembly includes a drawer that is slidably coupled to the housing.

17. The washstand of claim 16, wherein the air inlet is integrally formed by a bottom surface of the drawer.

18. The washstand of claim 17, wherein the second opening of the air inlet is removeably coupled to the second outlet of the dryer such that when the drawer is pulled out, the air inlet is decoupled from the dryer and when he drawer is pushed in, the air inlet is coupled to the dryer.

19. The washstand of claim 1, wherein the cabinet includes an inner cabinet having the inner space, and a base outer cabinet that covers a bottom portion of the inner cabinet, wherein the dryer is provided between the bottom portion of the inner cabinet and the base outer cabinet.

20. A washstand comprising:

a sink;

a faucet that supplies water to the sink; and a drain that removes water from the sink;

a cabinet provided below the sink and. having an inner space;

a dryer provided in the cabinet and including a first outlet under the cabinet in communication with an outside of the cabinet and a second outlet in communication with the inner space of the cabinet, the dryer being configured to selectively generate an airflow through the first outlet to the outside of the cabinet or through the second outlet to the inner space; and a drawer assembly provided in the inner space of the cabinet and configured to dry items received in the drawer assembly using heated air generated by the dryer.

* * * * *